US005983660A

United States Patent [19]

Kiessel et al.

[11] Patent Number: 5,983,660

[45] Date of Patent: Nov. 16, 1999

[54] DEFROST SUBCIRCUIT FOR AIR-TO-AIR HEAT PUMP

[75] Inventors: Thomas G. Kiessel, Traverse City, Mich.; Dennis L. Weston, Indianapolis, Ind.; Rex K. Ambs, Traverse City, Mich.

[73] Assignee: Geofurnace Systems, Inc., Grawn, Mich.

[21] Appl. No.: 09/007,322

[22] Filed: Jan. 15, 1998

[51] Int. Cl.[6] ..... F25B 13/00; F25B 47/00; F25D 23/12

[52] U.S. Cl. ..... 62/324.5; 62/260; 62/278

[58] Field of Search ..... 62/260, 324.1, 62/160, 275, 276, 278, 324.5; 165/45

[56] References Cited

U.S. PATENT DOCUMENTS

| | | | |
|---|---|---|---|
| 1,554,654 | 9/1925 | Prisner | 165/45 |
| 1,597,618 | 8/1926 | Prisner | 165/130 |
| 2,689,090 | 9/1954 | Wetherbee | 62/260 |
| 3,240,028 | 3/1966 | Redfern et al. | 62/324.1 |
| 3,882,937 | 5/1975 | Robinson | 166/267 |
| 4,171,721 | 10/1979 | Movick | 165/45 |
| 4,255,936 | 3/1981 | Cochran | 62/260 |
| 4,286,651 | 9/1981 | Steiger et al. | 165/45 |
| 4,325,228 | 4/1982 | Wolf | 62/260 |
| 4,409,796 | 10/1983 | Fisher | 62/160 |
| 4,512,156 | 4/1985 | Nagase | 60/641.2 |
| 4,671,351 | 6/1987 | Rappe | 165/133 |
| 4,714,108 | 12/1987 | Barry | 165/45 |
| 5,025,634 | 6/1991 | Dressler | 62/79 |
| 5,239,838 | 8/1993 | Tressler | 62/324.1 |
| 5,313,804 | 5/1994 | Kaye | 62/160 |
| 5,388,419 | 2/1995 | Kaye | 62/160 |
| 5,461,876 | 10/1995 | Dressler | 62/160 |

FOREIGN PATENT DOCUMENTS

| | | | |
|---|---|---|---|
| 2911425 | 9/1980 | Germany . | |
| 3015149 | 10/1981 | Germany | 165/45 |
| 3022588 | 12/1981 | Germany . | |
| 3142347 | 5/1983 | Germany . | |
| 3203526 | 8/1983 | Germany . | |
| 57-187557 | 11/1982 | Japan | 165/45 |
| 196933 | 10/1924 | United Kingdom . | |

*Primary Examiner*—William Doerrler
*Attorney, Agent, or Firm*—Warner Norcross & Judd LLP

[57] ABSTRACT

A heat pump system having a defrost subcircuit that draws heat from a geothermal heat source. The defrost subcircuit is connected to the outdoor air coil in parallel with the indoor coil. The system includes a control mechanism for selectively circulating refrigerant through the defrost subcircuit but not the indoor air coil during the defrost mode. The heat pump system further includes components which permit the defrost subcircuit to be pumped down when the system leaves the defrost mode.

18 Claims, 1 Drawing Sheet

DEFROST SUBCIRCUIT FOR AIR-TO-AIR HEAT PUMP

BACKGROUND OF THE INVENTION

The present invention relates to heating and cooling apparatus, and more particularly to a defrost subcircuit for use with an air-to-air heat pump.

Air-to-air heat pumps have been in widespread use throughout the United States for many years. These units operate to exchange heat between outdoor air and inside air. For example, a conventional heat pump can operate in either a heating mode during which heat is drawn from the outdoor air and used in heating the inside of the building or in a cooling mode during which heat is drawn from inside the building and released into the outdoor air. Because these systems transfer rather than generate heat, they are generally more efficient than conventional heating and cooling systems.

Air-to-air heat pumps are available in a variety of designs. A typical air-to-air heat pump includes an outdoor air coil unit located outside of the building, an indoor air coil unit located within the building, a plurality of refrigerant lines for interconnecting the indoor and outdoor units, and a control system for controlling operation of the heat pump. In the heating mode, liquid refrigerant enters the outdoor coil unit where it evaporates, thereby drawing heat from the external air into the refrigerant. The gas refrigerant flows from the outdoor coil unit through the refrigerant lines to the indoor coil unit. In the indoor coil unit, the gas refrigerant condenses back into a liquid, thereby releasing heat drawn from the outdoor air into the building. The liquid refrigerant then flows back to the outdoor coil unit to continue the cycle.

In the cooling mode, the process works essentially in reverse. Liquid refrigerant flows into the indoor coil unit where it evaporates to draw heat from the indoor air. The gas refrigerant flows through the refrigerant lines to the outdoor coil unit. In the outdoor coil unit, the refrigerant condenses, thereby releasing heat into the outdoor air. The liquid refrigerant then returns via the refrigerant lines to the indoor coil unit to continue the cycle.

Experience has revealed that when an air-to-air heat pump is operated in the heating mode at close to freezing temperatures, frost can form on the evaporator. This can significantly impair operation of the heat pump. Frost forms on the evaporator when the evaporator draws sufficient heat from the air surrounding the evaporator to freeze the moisture contained in the air. Frosting is typically not a problem at temperatures significantly above or below freezing because at higher temperatures there is enough heat in the air to prevent the moisture from freezing and at lower temperatures the moisture in the air is already frozen so it does not accumulate on the evaporator.

A number of methods have been developed to address the problem of frosting. For example, a number of conventional systems draw heat from inside the building to defrost the evaporator. These systems typically include an indoor coil that draws heat into the refrigerant from inside the building and then pumps the refrigerant through the external evaporator to remove the frost. This approach suffers in that it significantly reduces the efficiency of the heating system because heat is removed from the inside of building to defrost the evaporator. Drawing heat from inside the building can also generate an undesirable cold draft through the duct work. As another example, some systems include an electric heater located next to the evaporator. When the evaporator becomes frosted, the electric heater is turned on to remove the frost. This type of system is also inefficient because it requires operation of a separate electric heater.

SUMMARY OF THE INVENTION

The aforementioned problems are overcome by the present invention which provides a defrost circuit for an air-to-air heat pump in which the defrost circuit draws heat from a geothermal heat exchanger and is connected to the outdoor air coil unit in parallel with the indoor coil unit. The geothermal heat exchanger can be buried in the ground or submerged in a natural water source, such as a lake, river or underground well. The circuit includes control components that direct refrigerant from the outdoor air coil unit through the indoor coil unit during normal operation and from the outdoor air coil unit through the geothermal heat exchanger when defrosting of the outdoor air coil unit is required.

The present invention provides a simple defrost subcircuit that is easily retrofit to existing heat pump circuits. In the preferred embodiment, the defrost subcircuit can be installed without performing any work within the housings for the inside air coil unit or the outside air coil unit. Further, because the heat used to perform the defrost function is collected from a geothermal heat source, the defrost subcircuit is more efficient than conventional defrost methods which draw heat from the indoor air or require additional heating elements.

These and other object, advantages, and features of the invention will be readily understood and appreciated by reference to the detailed description of the preferred embodiment and the drawings.

DETAILED DESCRIPTION OF THE PREFERRED EMBODIMENT

Figure 1:
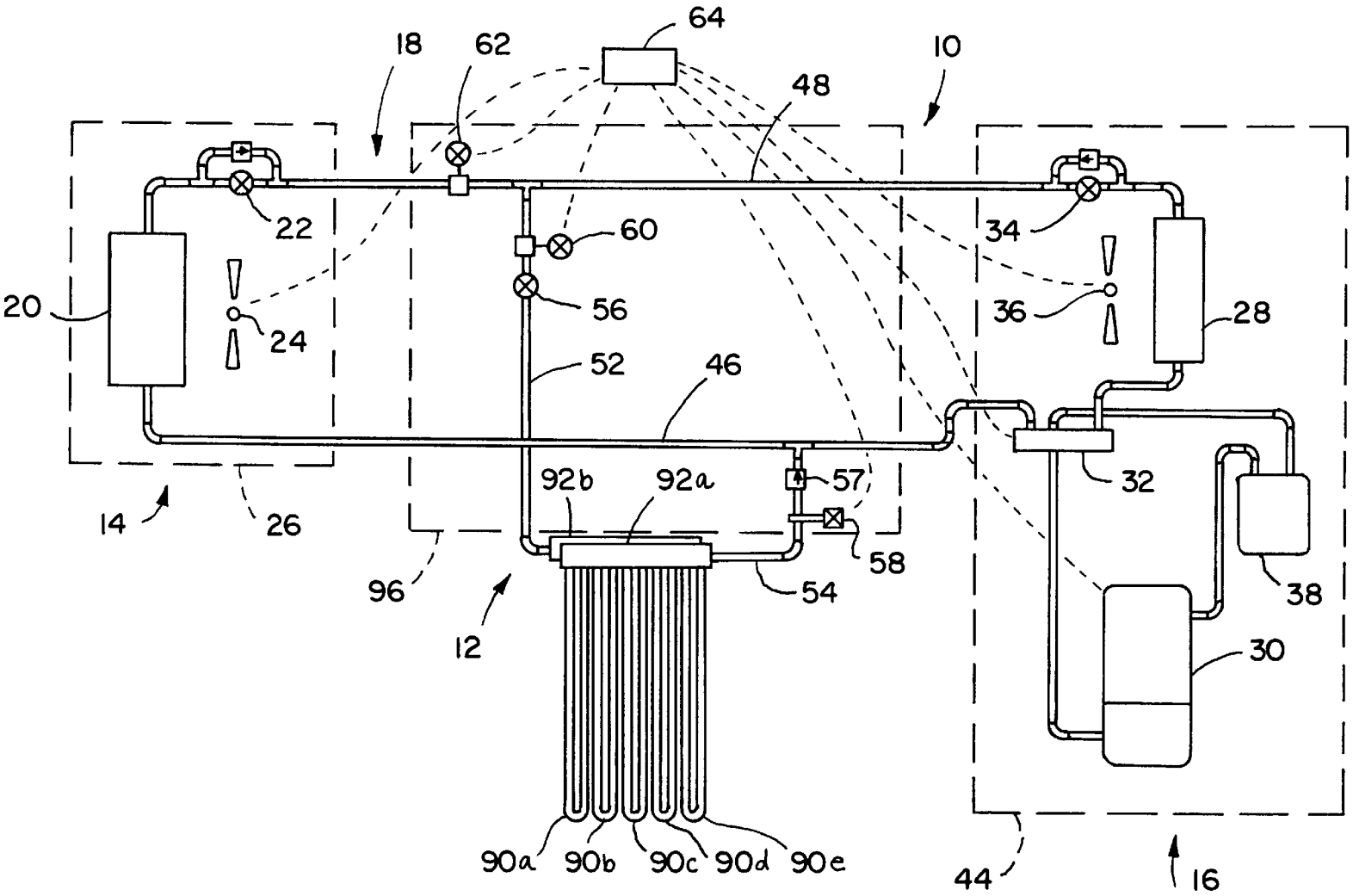
FIG. 1 is a schematic diagram of a heat pump circuit incorporating a defrost circuit according to a preferred embodiment of the present invention.

A heat pump system incorporating a defrost subcircuit in accordance with a preferred embodiment of the present invention is illustrated in FIG. 1 and generally designated 10. The heat pump system 10 operates to either cool or heat a space by transferring heat between the indoor air and the outdoor air. More specifically, in the cooling mode, the system 10 abstracts heat from the indoor air and releases it into the outdoor air, and in the heating mode, the system 10 abstracts heat from the outdoor air and releases it into the indoor air. For purposes of disclosure, the present invention is described in connection with a conventional heat pump circuit having a conventional indoor air coil unit 14 and a conventional outdoor air coil unit 16 interconnected by refrigerant lines 18. Except as described below, the operation and interrelationship of the components of the heat pump circuit are generally well known to those skilled in the field. Accordingly, the individual components will not be discussed in detail. However, a general summary of the Junction of these components will be provided. The present invention is well suited for use in connection with a wide variety of heat pump circuits having various designs and various capacities.

With the exception of the defrost subcircuit 12, the heat pump circuit 10 is generally conventional. As shown in FIG. 1, the outdoor air coil unit 16, such as Model No. 38Y030-30 from Carrier Corporation of Syracuse, N.Y., includes an outdoor air coil 28 for exchanging heat with the outdoor air, a compressor 30 for circulating refrigerant through the system, a reversing valve 32 for controlling the direction of flow of refrigerant through the system, an expansion device 34 for creating a pressure differential within the circuit during the cooling mode, and an outdoor fan 36 for moving outdoor air across the outdoor air coil 28. The expansion device 34 preferably includes a bypass which permits refrigerant to bypass the expansion device 34 during the heating mode. The outdoor air coil unit 16 may also include other conventional components, such as an accumulator 38, a low pressure switch 40, and a high pressure switch 42. The components of the outdoor air coil unit 16 are preferably contained within a single housing 44 located outside of the building.

The indoor air coil unit 14, such as Model No. FH4ANF-002 from Carrier Corporation of Syracuse, N.Y., includes an indoor air coil 20 for exchanging heat with the indoor air, an expansion device 22 for creating a pressure differential in the circuit during the heating mode, and a blower 24 for moving air across the coil 20. The expansion device 22 preferably includes a bypass which permits refrigerant to bypass the expansion device 22 during the cooling mode. These components are typically contained within a single housing 26 that is integrated with or connected to the building's duct work in a conventional manner. The indoor air coil unit 14 is interconnected with the outdoor air coil unit by a gas refrigerant line 46 extending between the indoor air coil 20 and the outdoor air coil 28, and a liquid refrigerant line 48 extending between the compressor 30 and the indoor air coil 20. The refrigerant lines 46 and 48 are generally conventional and are preferably conventional copper tubing. The diameter of the refrigerant line will vary from application to application depending on the capacity and design of the heat pump circuit and the type of refrigerant used in the circuit. However, in this embodiment, the liquid refrigerant line 48 is preferably three-eighths of an inch in diameter and the gas refrigerant line 46 is preferably three-fourths of an inch in diameter.

The defrost subcircuit 12 is connected to the heat pump circuit 10 in parallel as shown in FIG. 1, and includes a geothermal heat exchanger 50, a refrigerant line 52 extending between the heat exchanger 50 and the liquid refrigerant line 48, a refrigerant line 54 extending between the heat exchanger and the gas refrigerant line 46, a fixed orifice 56 installed in refrigerant line 52 for creating a pressure differential in the circuit during the defrost mode, a check valve 57 installed in refrigerant line 54 to prevent refrigerant from flowing backwards into the heat exchanger 50 from the gas refrigerant line 46, a pair of solenoid valves 60 and 62 that control the flow of refrigerant through the heat exchanger 50, and a low pressure sensor 58 for controlling the timing of the solenoid valves when the system leaves the defrost mode. With the exception of the heat exchanger 50, the components of the defrost subcircuit 12 are preferably contained within a single housing 96.

The present invention is well suited for use with a wide variety of conventional geothermal heat exchangers. However, in the preferred embodiment, the heat exchanger 50 is designed for use with the matched indoor air coil unit and outdoor air coil unit combination described above, which is a two and one-half ton unit providing approximately 30,000 BTUs. The heat exchanger 50 includes a plurality of loops 90*a–e* interconnected with a pair of conventional manifolds 92*a–b*. Each loop 90*a–e* includes a generally U-shaped section of conventional copper tubing having a diameter of three-eighths of an inch and a length of approximately fifty feet (overall loop length of approximately twenty-five feet). The number of loops and the diameter and length of each loop will vary from application to application depending on a variety of factors, including without limitation the volume of heat exchange desired, the type of refrigerant used in the circuit, the capacity of the system, the pressure differential in the circuit, the climate in which the system is installed, and the makeup of the geothermal heat source. The distribution manifold 92*a* interconnects the input end of each loop 90*a–c* with the refrigerant line 52. The output manifold 92*b* interconnects the output end of each loop 90*a–e* with the refrigerant line 54. This permits refrigerant to flow through the loop 90*a–e* in parallel.

The heat pump circuit 10 also includes a control mechanism 64 for controlling the operation of the reversing valve 32, the solenoid valves 60 and 62, and other elements of the circuit 10. The control mechanism 64 is preferably a conventional electromechanical control system that receives input from a conventional control panel (not shown) and the low pressure sensor 58. The control mechanism 64 may include a conventional timer for timing operation of the defrost circuit. Operation of the control mechanism will be described in more detail below.

Installation and Operation

The indoor air coil unit 14 and outdoor air coil unit 16 are installed in a conventional manner using conventional techniques and apparatus. The indoor and outdoor air coil units are preferably purchased as pre-assembled units from any of a variety of well known suppliers. Alternatively, the units can be assembled from the components described above. In either event, the indoor and outdoor units are interconnected by liquid refrigerant line 48 and gas refrigerant line 46 as described above, and the reversing valve 32 is operatively connected to the control mechanism 64 using conventional techniques and apparatus.

The defrost subcircuit 12 can be installed during initial installation of the heat pump circuit or it can be retrofit to an existing heat pump circuit. The heat exchanger 50 is buried in the ground or submerged in a river, lake, well or other body of water, and then interconnected with the heat pump circuit by refrigerant lines 52 and 54. Typically, the heat exchanger will be buried in the ground. In such cases, the loops 90–*c* can be buried collectively in a single bore or individually buried in separate bores. Refrigerant line 52 is preferably connected at one end to the distribution manifold 92*a* and at the other end to the liquid refrigerant line 48 by a conventional "T" joint 70. Similarly, refrigerant line 54 is preferably connected at one end to the output manifold 92*b* and at the other end to the gas refrigerant line 46 by a conventional "T" joint 72. The solenoid valve 60 and the fixed orifice 56 are installed in refrigerant line 52 while the low pressure sensor 58 and the check vavle 57 are installed in refrigerant line 54. The solenoid valve 62 is also installed in the liquid refrigerant line 48 between the indoor air coil unit 14 and the "T" joint 70. The low pressure sensor 58 and the solenoid valves 60 and 62 are then operatively connected to the control mechanism 64 using conventional techniques and apparatus.

The heat pump system 10 is capable of operation in three separate modes; namely cooling mode, heating mode, and defrost mode. In the cooling mode, the control mechanism 64 places the reversing valve 32 in the cooling position so that refrigerant flows from the gas refrigerant line 46 through the accumulator 38 and the compressor 30 to the outdoor air coil 28. The control mechanism 64 also opens solenoid valve 62 and closes solenoid valve 60. In the outdoor air coil 28, the vaporized refrigerant condenses into a high pressure liquid thereby releasing heat energy into the outdoor air. The transfer of heat is expedited by the outdoor fan 36 which moves air over the outdoor air coil 28. The liquid refrigerant flows from the outdoor air coil 28 into the liquid refrigerant line 48. The liquid refrigerant flows through the bypass valve of the expansion device 34. Because solenoid valve 60 is closed, refrigerant does not flow to the heat exchanger. Instead, the refrigerant flows through open solenoid valve 62 and eventually through expansion device 22. The expansion device 22 meters the refrigerant to separate the high pressure side of the circuit from the low pressure side of the circuit. The liquid refrigerant flows through the expansion device 22 into the indoor air coil 20. In the indoor air coil 22, the liquid refrigerant evaporates into a gas, thereby abstracting heat from the indoor air. From the indoor air coil 22, the low pressure gas refrigerant flows through the gas refrigerant line 46 back to the reversing valve to repeat the cycle. The check valve 57 prevents gas refrigerant from flowing into refrigerant line 54.

In the heating mode, the cycle is essentially reversed. The control mechanism 64 places the reversing valve 32 in the heating position so that refrigerant flows from the outdoor air coil 28 through the accumulator 38 and the compressor 30 to the gas refrigerant line 46. The control mechanism 64 also opens solenoid valve 62 and closes solenoid valve 60 (if the valves are not already in those positions). The vaporized refrigerant flows from the reversing valve 32 through the gas refrigerant line 46 to the indoor air coil 20. The check valve 57 prevents gas refrigerant from flowing into refrigerant line 54. In the indoor air coil 20, the vaporized refrigerant condenses into a high pressure liquid, thereby releasing heat energy into the indoor air. The transfer of heat is expedite by the indoor blower 24 which moves air over the indoor air coil 20. The liquid refrigerant flows from the indoor air coil 20 into the liquid refrigerant line 48. The liquid refrigerant flows through the expansion device 22, which meters the refrigerant to separate the high pressure side of the circuit from the lower pressure side of the circuit. Because solenoid valve 60 is closed, refrigerant does not flow to the heat exchanger. Instead, the refrigerant flows through the open solenoid valve 62, the bypass of the expansion device 34, and eventually to the outdoor air coil 28. In the outdoor air coil 28, the liquid refrigerant evaporates into a gas, thereby abstracting heat from the outdoor air. From the outdoor air coil 28, the low pressure gas refrigerant flows back to the reversing valve 32 to repeat the cycle.

As described in the Background, frost may accumulate on the outdoor air coil 28 when the system 10 is operating in the heating mode and the exterior temperature is near freezing (e.g between approximately 25 and 37 degrees Fahrenheit). The defrost subcircuit 12 is designed to use heat energy from a geothermal heat source to defrost the outdoor air coil 28. The system 10 preferably enters into the defrost mode approximately every 60 minutes when both the system 10 is in the heating mode and the outdoor temperature falls within the frost range (e.g. 25 degrees to 37 degrees Fahrenheit). Alternatively, other conventional methods can be used for determining when the system should enter into the defrost mode. In the defrost mode, the control mechanism 64 moves the reversing valve 32 into the cooling position, closes solenoid valve 62, and opens solenoid valve 60. Accordingly, refrigerant flows from the gas refrigerant line 46 through the accumulator 38 and the compressor 30 to the outdoor air coil 28. In the outdoor air coil 28, the vaporized refrigerant condenses into a high pressure liquid, thereby releasing heat energy into the outdoor air. This heat energy functions to melt away any frost collected on the outdoor air coil 28. The outdoor fan 36 is turned off by the control system during the defrost mode. The liquid refrigerant flows from the outdoor air coil 28 into the liquid refrigerant line 48. The liquid refrigerant flows through the bypass valve of the expansion device 34. Because solenoid valve 62 is closed, refrigerant does not flow to the indoor air coil 22. Instead, the refrigerant flows through refrigerant line 52, which includes open solenoid valve 60 and fixed orifice 56. The fixed orifice 56 meters the refrigerant to separate the high pressure side of the circuit from the low pressure side of the circuit. The liquid refrigerant flows through the fixed orifice 56 into the distribution manifold 92*a* of the heat exchanger 50. From the distribution manifold 92*a* the refrigerant flows in parallel through the various loop 90*a–e*. In the loops 90*a–e*, the refrigerant evaporates into a gas, thereby abstracting heat from the geothermal heat source. The vaporized refrigerant flows from the loops 90*a–e* into the output manifold 92*b* and then into refrigerant line 54. From refrigerant line 54, the refrigerant return to gas refrigerant line 46 and then the reversing valve 32, after which it repeats the cycle.

The system 10 will preferably remain in the defrost mode for a predetermined period of time, which will vary from application depending on the estimated amount of time needed to defrost the circuit. In the preferred embodiment, the system 10 will remain in the defrost mode for approximately ten minutes. However, the length of the defrost cycle will vary from application to application. In order to return the system 10 to the heating mode, solenoid valve 60 is closed while the compressor 30 continues to run. This permits the compressor 30 to pump down, or draw refrigerant out of the defrost subcircuit. The low pressure sensor 58 in refrigerant line 54 is actuated when the compressor 30 has pumped the defrost subcircuit down to the appropriate level. Once the switch is actuated, a signal is sent to the control mechanism 64. In response to this signal, the control mechanism 64 opens solenoid valve 62 and returns the reversing valve 32 to the heating position.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A heat pump comprising:

an indoor coil unit;

an outdoor air coil unit;

a plurality of refrigerant lines interconnecting said indoor coil unit and said outdoor coil unit, said plurality of refrigerant lines includes a liquid refrigerant line interconnecting said outdoor air coil unit with said indoor coil unit, said plurality of refrigerant lines includes a gas refrigerant line interconnecting said outdoor air coil unit with said indoor coil unit;

a defrost subcircuit connected to said outdoor air coil unit in parallel with said indoor coil unit, said defrost subcircuit including a geothermal heat exchanger means for drawing heat from a geothermal heat source, said plurality of refrigerant lines further includes a first refrigerant line interconnecting said geothermal heat exchanger means with said liquid refrigerant line; and a circuit control means for selectively moving the heat pump between a heating mode in which refrigerant cycles between said indoor coil unit and said outdoor air coil unit and a defrost mode in which refrigerant cycles between said outdoor air coil unit and said geothermal heat exchanger means, whereby said geothermal heat exchanger means receives refrigerant from said liquid refrigerant line when the heat pump is operating in said defrost mode.

2. The heat pump of claim 1 wherein said plurality of refrigerant lines includes refrigerant line interconnecting said outdoor air coil unit with said indoor coil unit; and a second refrigerant line interconnecting said geothermal heat exchanger means with said gas refrigerant line.

3. The heat pump of claim 2 wherein said circuit control means includes:

a first valve located in said first refrigerant line;

a second valve located in said liquid refrigerant line between said indoor coil unit and said first refrigerant line; and a valve control means for selectively opening and closing said first valve and said second valve.

4. The heat pump of claim 3 wherein said circuit control means includes a defrost subcircuit pump down means for removing refrigerant from said defrost subcircuit when said heat pump leaves a defrost mode.

5. The heat pump of claim 4 wherein said circuit control means includes a low pressure sensor for sensing when said defrost circuit is sufficiently pumped down.

6. The heat pump of claim 5 wherein said circuit control means includes a reversing valve for reversing a direction of flow of refrigerant.

7. The heat pump of claim 6 wherein said defrost subcircuit includes a fixed orifice on said first refrigerant line.

8. An apparatus comprising:

a heat pump including:

an indoor coil;

an outdoor coil;

heat pump refrigerant lines interconnecting said indoor coil and said outdoor coil, said heat pump refrigerant lines includes a gas refrigerant line and a liquid refrigerant line;

a compressor adapted to cycle a refrigerant between said indoor coil and said outdoor coil through said refrigerant lines;

a reversing valve for controlling direction of flow of refrigerant through said heat pump; a defrost subcircuit including:

a geothermal heat exchanger means for abstracting heat from a geothermal heat source;

defrost subcircuit refrigerant lines connecting said geothermal heat exchanger means with said outdoor coil in parallel with said indoor coil, said defrost subcircuit refrigerant lines includes a first refrigerant line connecting said geothermal heat exchanger means with said liquid refrigerant line;

valve means having a first position for directing refrigerant flow to cycle between said outdoor coil and said indoor coil, said valve means having a second position for directing refrigerant flow to cycle between said said outdoor coil and said geothermal heat exchanger means; and a control means for controlling operation of the reversing valve and the valve means to move the apparatus between a heating mode and a defrost mode, wherein refrigerant enters said geothermal heat exchanger means from said liquid refrigerant line when in said defrost mode.

9. The apparatus of claim 8 wherein said defrost subcircuit refrigerant lines includes a second refrigerant line connecting said geothermal heat exchanger means with said gas refrigerant line.

10. The apparatus of claim 9 further comprising an expansion device installed in said first refrigerant line.

11. The apparatus of claim 10 wherein said valve means includes a first valve installed in said liquid refrigerant line between said indoor coil and said first refrigerant line.

12. The apparatus of claim 11 wherein said valve means includes a second valve installed in said first refrigerant line.

13. The apparatus of claim 12 wherein said control means includes a defrost subcircuit pump down means for removing refrigerant from said defrost subcircuit when said heat pump leaves said defrost mode.

14. The apparatus of claim 13 wherein said control means includes a low pressure sensor for sensing when said defrost circuit is sufficiently pumped down.

15. A heat pump apparatus comprising:

a circuit;

refrigerant contained within said circuit, said refrigerant adapted to cycle through said circuit;

an outdoor air coil included within said circuit and adapted to transfer heat between said refrigerant and outdoor air;

a defrost subcircuit included within said circuit and adapted to transfer heat from a geothermal heat source into said refrigerant;

said circuit including a plurality of refrigerant lines interconnecting said outdoor air coil and said defrost subcircuit, said plurality of refrigerant lines including a first refrigerant line connecting said defrost subcircuit with a liquid refrigerant line;

a control means for moving said circuit between a heating mode in which said refrigerant is cycled through said outdoor air coil to abstract heat from the outdoor air and a defrost mode in which said refrigerant is cycled through said defrost subcircuit to abstract heat from the geothermal heat source and through said outdoor air coil to release the heat abstracted from the geothermal heat source into the outdoor air.

16. The apparatus of claim 15 further comprising an indoor coil for exchanging heat between said refrigerant and indoor air; and said heating mode further including cycling said refrigerant through said indoor coil to release heat abstracted from the outdoor air into the indoor air.

17. The apparatus of claim 16 wherein said refrigerant is not cycled through said indoor coil during said defrost mode.

18. The apparatus of claim 19 wherein said plurality of refrigerant lines interconnects said indoor coil with said outdoor air coil and said defrost subcircuit; and wherein said control means includes a plurality of valves for selectively closing selected refrigerant lines and a reversing valve for selectively controlling a direction of flow of said refrigerant through said circuit.

* * * * *

UNITED STATES PATENT AND TRADEMARK OFFICE

CERTIFICATE OF CORRECTION

PATENT NO. : 5,983,660

DATED : November 16, 1999

INVENTOR(S) : Thomas G. Kiessel et al

It is certified that error appears in the above-indentified patent and that said Letters Patent is hereby corrected as shown below:

Column 8, Claim 18, Line 57:
"19" should be --17--

Signed and Sealed this

Twentieth Day of June, 2000

*Attest:*

Q. TODD DICKINSON

*Attesting Officer*

*Director of Patents and Trademarks*